US005452969A

United States Patent [19]

Crook

[11] Patent Number: 5,452,969

[45] Date of Patent: Sep. 26, 1995

[54] APPARATUS FOR SCREENING AND SPREADING BEDDING MATERIAL IN A DITCH

[76] Inventor: William A. Crook, 347 Peretz Cir., Circle City, Ariz.

[21] Appl. No.: 189,805

[22] Filed: Feb. 1, 1994

[51] Int. Cl.[6] ..... F16L 1/028

[52] U.S. Cl. ..... 405/303; 405/157; 405/179

[58] Field of Search ..... 405/50, 154, 157, 405/174, 179, 268, 283, 303; 404/108, 110

[56] References Cited

U.S. PATENT DOCUMENTS

| | | | |
|---|---|---|---|
| 3,664,137 | 5/1972 | Lett . | |
| 4,462,715 | 7/1984 | Ashbaugh . | |
| 4,714,381 | 12/1987 | Hatch . | |
| 4,741,646 | 5/1988 | Hatch . | |
| 4,955,756 | 9/1990 | Klamar | 405/179 |
| 5,145,290 | 9/1992 | Wise | 405/179 |
| 5,158,394 | 10/1992 | Bresnahan . | |
| 5,174,685 | 12/1992 | Buchanan . | |
| 5,259,699 | 11/1993 | Klamar | 405/179 |

*Primary Examiner*—David H. Corbin
*Attorney, Agent, or Firm*—James E. Bradley; Mark Handley

[57] ABSTRACT

An apparatus for spreading a bedding material in a ditch to provide a bedding layer for laying a pipe thereon is disclosed. The apparatus includes a screened opening which extends for selectively passing bedding material below a readily selected particulate size, and particulate matter above the selected particulate size is directed forward of the apparatus. The apparatus further includes a discharge opening having side plates which control the width of the bedding layer. The discharge opening also has a back-skid plate for controlling the vertical thickness of the bedding layer. The back-skid plate is a horizontally extending plate which is adjustable for selectively determining the vertical thickness of the bedding layer deposited.

20 Claims, 2 Drawing Sheets

APPARATUS FOR SCREENING AND SPREADING BEDDING MATERIAL IN A DITCH

BACKGROUND OF THE INVENTION

1. Field of the Invention

This invention relates in general to spreading a bedding material within a ditch, and in particular to a method and apparatus for spreading sand in a ditch to provide a compliant bedding layer for laying a pipe upon.

2. Description of the Prior Art

A typical method for spreading bedding material within a ditch to provide a bedding layer for laying a pipe on is to, by means of an excavator such as a backhoe, dump the bedding material within the ditch. Then, shovels and the like are used by manual laborers to spread the bedding material by hand. This method is very labor intensive and may not efficiently achieve desired results for the bedding layer. For example, the bedding material may need to be screened and spread to a uniform consistency and height as is typically specified for bedding layers for laying pipe upon.

Spreading devices for spreading different materials upon a ground surface can be seen in several prior art patents. For example, U.S. Pat. No. 5,174,685, issued to Buchanan, on Dec. 29, 1992, discloses a flexible pipe laying and covering apparatus which has a vertically shiftable scraper for adjusting the height of fill material. Further, U.S. Pat. No. 4,714,381, issued on Dec. 22, 1987, and U.S. Pat. No. 4,741,646, issued on May 3, 1988, and both invented by Hatch, disclose a machine for laying conduit and methods for use thereof having an adjustable leveler gate which is formed by a vertical plate.

Often, pipe laying applications require that pipes are laid in a compliant bedding layer to prevent damage to the pipes which may occur from shifting soil and heavy loads applied to a ground surface beneath which the pipes are berried. In such cases, a compliant bedding layer is required, such as one that can be obtained utilizing sand rather than stones or rocks.

U.S. Pat. No. 4,464,715, issued to Ashbaugh, on Jul. 31, 1984, discloses a system for the one-step dewatering of a trench and the construction of a pipeline bed which includes horizontal plates for controlling the height of a bedding layer. However, the horizontal plates disclosed in Ashbaugh are not readily adjustable for selecting the vertical thickness of the bedding layer. Further, the bedding material disclosed in Ashbaugh is stone, and not sand.

U.S. Pat. No. 5,158,394, issued to Bresnahan, on Oct. 27, 1992, discloses a spreader device having an L-shaped bar which is adjustable to set a height of sod spread on an open field, such as a golf course. However, the spreader device in Bresnahan is for spreading particulate matter on an open field, and not intended for laying a bedding layer for a pipe in a ditch.

When a compliant bedding layer is required, such as one provided by depositing sand, often a maximum particle size is specified for the bedding material. Sand may often be presorted to remove large particles above a particular size, however, sand is often received at an excavation site which includes rather large particles which would interfere with providing a compliant bedding layer. Frequently, different particle sizes may be specified such that it is desirable to have a readily removable and readily interchangeable screening device.

U.S. Pat. No. 4,741,646, issued on May 3, 1988, and invented by Hatch, discloses a machine for laying conduit and methods for use thereof, which is briefly discussed above. Hatch discloses a screen for covering an upper opening for passing fill material therethrough. However, Hatch does not disclose a readily removable screen which may be interchanged for selectively preventing particulate matter above a certain size from entering a prior art bedding layer spreader.

SUMMARY OF THE INVENTION

A method and apparatus are provided for spreading a bedding material in a ditch to provide a bedding layer for laying a pipe thereon. The apparatus includes a hopper having a screened opening which extends for selectively passing bedding material below a readily selected particulate size. The particulate matter above the selected particulate size is directed forward of the apparatus. A container receives bedding material from the hopper and includes a discharge opening having side plates which control the width of the bedding layer. The discharge opening also has a back-skid plate for controlling the vertical thickness of the bedding layer. The back-skid plate is a horizontally extending plate which is adjustable for selectively determining the vertical thickness of the bedding layer deposited.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
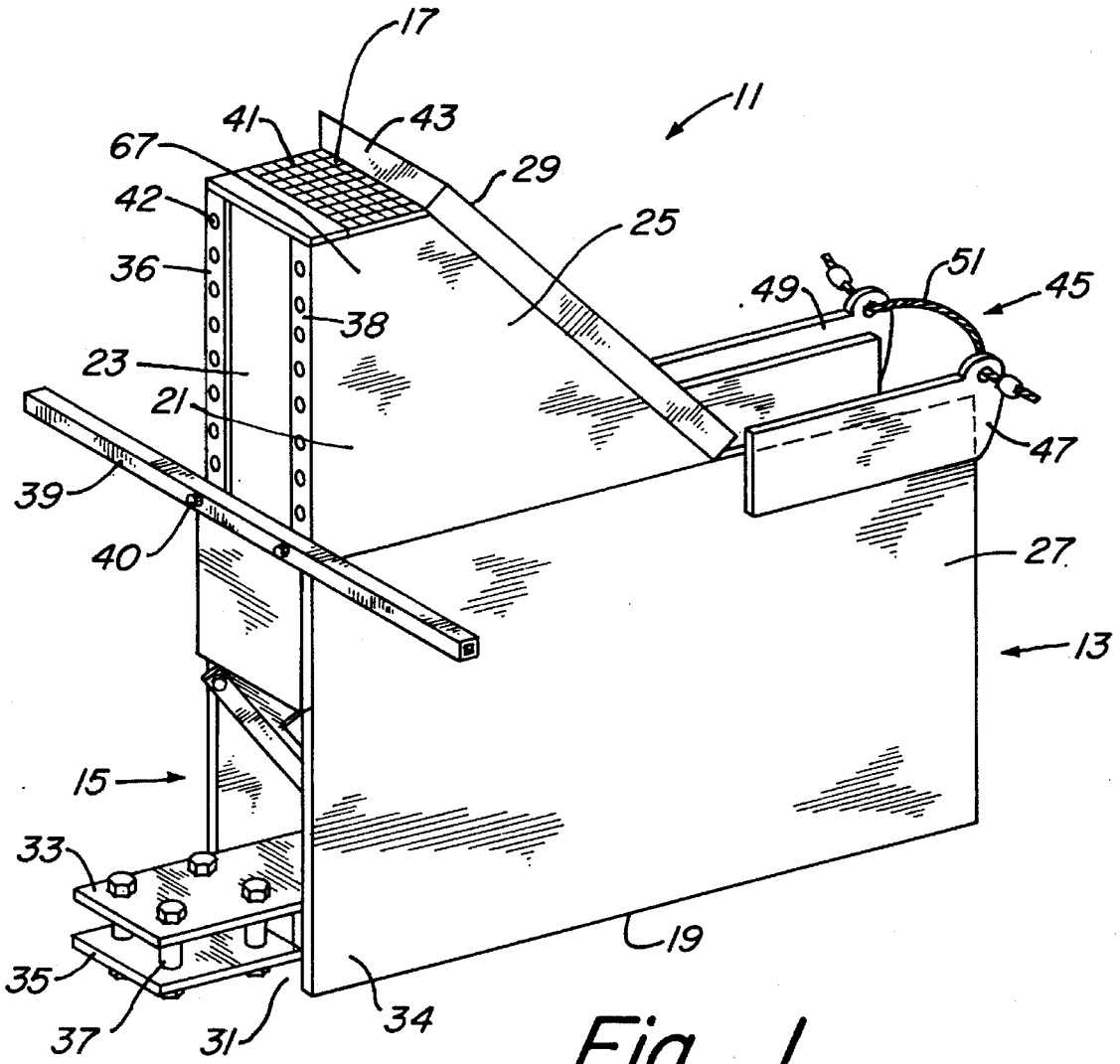
FIG. 1 is a perspective view depicting a bedding material spreader of the preferred embodiment of the present invention.

Referring to FIG. 1, a perspective view depicts bedding material spreader 11, which in the preferred embodiment of the present invention is an apparatus for spreading sand in a ditch to provide a compliant bedding layer for laying a pipe either on top of, or within. Spreader 11 has forward end 13, aft end 15, top 17, bottom 19, and laterally opposed pair of parallel sidewalls 21 and 23. Spreader 11 has two primary sections, hopper 25, and container 27.

Opening 29 in hopper 25 provides an intake opening for spreader 11. Lower opening 31 in container 27 provides a discharge opening for container 11. Discharge opening 31 includes upper back-skid plate 33 to which lower back-skid plate 35 may be releasably secured by means of four bolts 37. Lower back-skid plate 35 is parallel to upper back-skid plate 33 and spaced above the lower edges of sidewalls 21 and 23. Discharge opening 31 is formed, as shown in FIG. 1, by lower back-skid plate 35 and aft lower portions 32 and 34 (shown in FIG. 2) of laterally opposed pair of sidewalls 21 and 23. Lower back-skid plate 35 may be removed from spreader 11 so that only upper back-skid plate 33 is used with the preferred embodiment of the present invention. This increases the depth of the fill. Upper back-skid plate 33 and lower back-skid plate 35 extend for eighteen (18) inches beyond the rearmost ends of sidewalls 21 and 23.

Stabilizer arms 39 are provided by a bar of square tubing to prevent bedding material spreader 11 from tipping over during use within a ditch. Stabilizer arms 39 are secured to channel iron members 36 and 38 by bolts 40, which extend through holes 42. Holes 42 are spaced apart through channels 36 and 38 to allow stabilizer arms 39 to be adjusted to different heights from bottom 19 of spreader 11. Stabilizer arms 39 are adjustable to different heights so that they can be aligned with the top of the ditch to provide a means for visual depth control. Thus, stabilizer bars provide both a guage for monitoring the depth of a ditch being filled, as well as laterally extending arms to prevent bedding material spreader 11 from tipping over during use within a ditch. Overspill screen 41 is provided on top of spreader 11. Angled sidewalls 43 are provided about intake opening 29 to funnel bedding material inwardly toward opening 29.

Tow fixture 45 provides a means for moving spreader 11 for spreading the bedding material to provide a bedding layer. Tow fixture 45 includes first tow plate 47 which is welded to sidewall 21, and second tow plate 49 which is welded to sidewall 23. Holes are provided in first and second tow plates 47 and 49 for passing tow cable 51 therethrough. Tow cable 51 is secured between tow fixture 45 for securing to an excavator (not shown), such as a backhoe, for pulling spreader 11 within the ditch in which the bedding layer is being spread.

Figure 2:
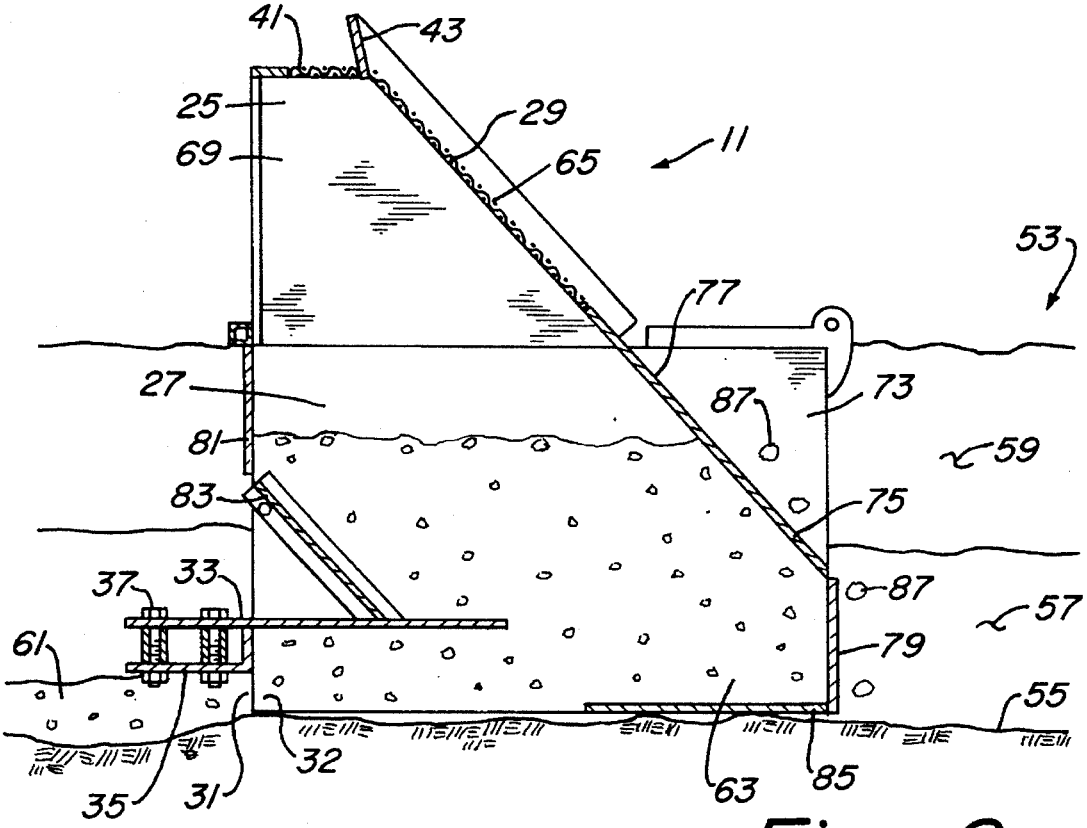
FIG. 2 is a vertical, longitudinal section view of the bedding material spreader of FIG. 1, shown within a ditch for spreading a bedding layer therein.

Referring to FIG. 2, a vertical, longitudinal section view depicts spreader 11 within ditch 53. Ditch 53 includes bottom 55, lower sidewall 57, and upper sidewall 59. Bedding layer 61 is shown after being laid by spreader 11 on bottom 55 of ditch 53. In the preferred embodiment of the present invention, bedding layer 61 is a compliant bedding layer to prevent damage to a pipe which is subsequently laid in ditch 53 on top of bedding layer 61. Bedding material 63 is provided to form bedding layer 61, and in the preferred embodiment is substantially comprised of sand. It should be noted that spreader 11 may be used to spread other types of materials, such as gravel and the like.

Readily removable screen 65 is provided to remove particles from sand which are larger than a predetermined size. In some embodiments of the present invention, screen 65 may be removed for using spreader 11 to deposit sand that has already been prescreened, or for use with other materials. Screen 65 may be selected from between several screens having different mesh sizes for selecting the predetermined sizes of particles of bedding material for passing into hopper 25 and container 27. Screen 65 is readily removable to allow removal and interchange of different screens having different mesh sizes.

Hopper 25 includes hopper sidewall plate 67 (shown in FIG. 1) and hopper sidewall plate 69. Container 27 includes sidewall plate 71 (shown in FIG. 3) and sidewall plate 73. Hopper sidewall plate 67 (not shown) and sidewall plate 71 (shown in FIG. 3) together provide sidewall 21 (shown in FIG. 1), and hopper sidewall plate 69 and sidewall plate 73 together provide sidewall 23 (shown in FIG. 1).

Container 27 further includes forward end plate 79 which provides a forward end for retaining bedding material 63 within container 27. Upper aft end plate 81 and lower aft end plate 83 provide an aft, or rear end, for retaining bedding material 63 within container 27. Forward skid plate 85 extends rearward from the lower end of forward end plate 79 and provides a forward bottom for skidding spreader 11 along bottom 55 of ditch 53. Forward skid plate 85 terminates about halfway from the forward end of container 26, to provide a hole in the bottom of container 26 which extends into discharge opening 31.

Figure 3:
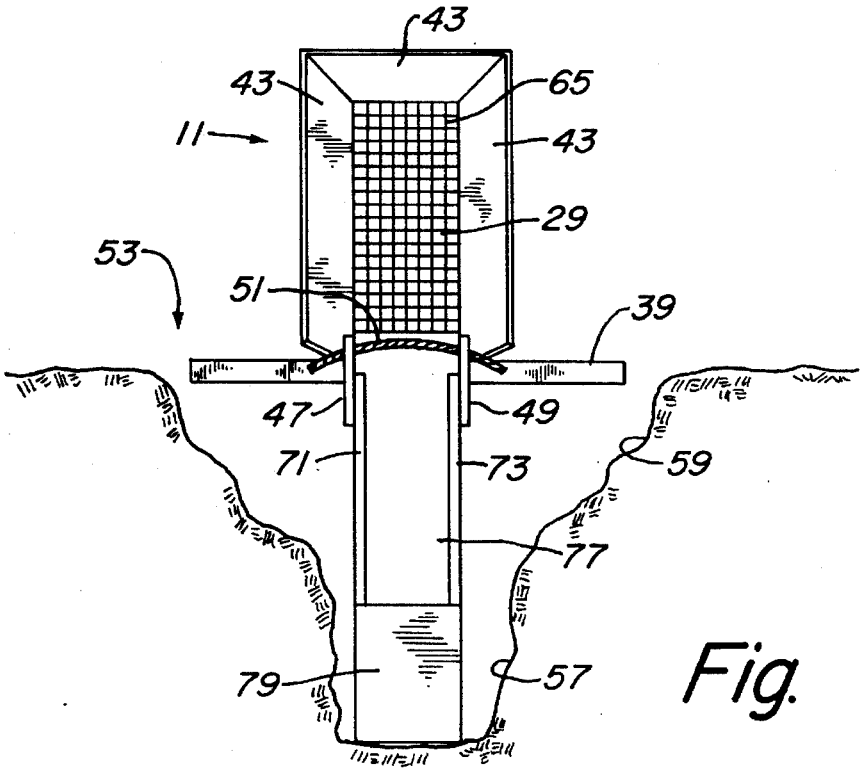
FIG. 3 is a side view of the bedding material spreader of FIGS. 1 and 2, shown within the ditch of FIG. 2.

Referring to FIG. 3, a front view depicts spreader 11 within ditch 53. Lower sidewall 57 of ditch 53 is substantially vertical, and upper sidewall 59 is substantially at a 45° degree angle to prevent ditch 53 from caving in. Stabilizer arms 39 are shown to prevent spreader 11 from tipping over by means of, for example, engaging upper sidewall 59. Angled sidewalls 43 are shown disposed about screen 65 over intake opening 29. Additionally, tow cable 51 is shown extending between and secured within first tow plate 47 and second tow plate 49.

Spoil chute plate 75 extends between sidewall plate 71 and sidewall plate 73. Together, sidewall plate 71, sidewall plate 73, and spoil chute plate 75 provide spoil chute 77 for directing particulate matter which screen 65 prevents from passing through opening 29, toward the forward end of bedding material spreader 11.

Operation of bedding material spreader 11 is now described. Referring to FIGS. 1 and 3, stabilizer arms 39 are first adjusted to align with the ground surface at the top of ditch 53. Bolts 40 are secured in holes 42 through channel iron members 36 and 38 to adjust the height of stabilizer arms 39 for visually monitoring the depth of ditch 53. If the depth of ditch 53 is found to not be correct, additional fill can be added, or ditch 53 can be deepened.

Referring to FIGS. 2 and 3, an excavator (not shown), such as a backhoe, is utilized to load bedding material 63 into spreader 11 by dumping the bedding material 63 on top screen 65. Particulate matter 87 which is larger than the grid size for screen 65 will pass down spoil chute 77 and discharge on the forward end of spreader 11, opposite of the aft end of spreader 11 where bedding layer 61 is deposited. Bedding material 63 which is smaller than the predetermined size for passing through screen 65 will fall through intake opening 29 and downward into container 27 to a level which is preferably above the top of lower back-skid plate 35. Then spreader 11 is pulled forward within ditch 53 by, for example, catching tow cable 51 with a bucket of a backhoe used for loading bedding material 63 within spreader 11, and pulling spreader 11 forward. As bedding material spreader 11 moves forward within ditch 53, bedding material 63 exits through discharge opening 31 to deposit bedding layer 61 on bottom 55 of ditch 53.

The height of fill, or vertical thickness, of bedding layer 61 is determined by the distance between the bottom of lower back-skid plate 35 and bottom 19 of spreader 11, which sits on and skids along bottom 55 of ditch 53. The vertical thickness of bedding layer 61 may be adjusted by increased by removing lower back-skid plate 35 so that only upper back-skid plate 33 is used. In the preferred embodiment of the present invention, the vertical thickness of bedding layer 61 is eight-tenths (8/10) feet when only upper back-skid plate 33 is utilized. The vertical thickness of bedding layer 61 is six-tenths (6/10) feet when lower back-skid plate 35 is used at a nominal spacing from upper back-skid plate 33. These two thicknesses are typical of conventional specifications for fill.

It should also be noted that upper back-skid plate 33 and lower back-skid plate 35 are horizontal plates as opposed to vertical plates. A horizontal plate has advantages over vertical plates in that when a material such as sand is used for bedding material 63, the sand tends to flow to a height which varies above the bottom of a vertical plate. In the preferred embodiment of the present invention, upper back-skid plate 33 and lower back-skid plate 35 both extend for eighteen (18) inches beyond the rearward end of sidewall plates 71 and 73 to prevent the sand which is used for bedding material 63 in the preferred embodiment of the present invention from rising above a preselected height. This provides a uniform vertical thickness for bedding layer 61 as opposed to a much less controllable vertical thickness for bedding layer 61 which would be obtained by using a vertical plate rather than a horizontal plate.

Referring to FIGS. 1 and 2, sidewalls 21 and 23 include lower aft ends 32 and 34 of sidewall plates 71 (shown in FIG. 3) and 73 which act as blades for controlling the horizontal width of bedding material 61. Thus, both the vertical thickness and the horizontal width of bedding material 61 are controlled by bedding material spreader 11 of the preferred embodiment of the present invention.

The present invention has several advantages. First, as mentioned above, a bedding layer is provided which has a predetermined vertical thickness and horizontal width, even using bedding materials which will flow, such as sand. Additionally, a readily removable screen is provided which may be quickly and easily interchanged with screens of different mesh sizes to selectively prevent particulate matter above a predetermined size from being laid within the bedding layer. Oversized particulate matter is directed forward of the bedding material spreader so that an excavator, such as a backhoe, may remove the oversized particulate matter from in front of the spreader. Further, the screen may be easily removed for use with bedding materials which have already been presorted to remove oversized particulate matter.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. In an apparatus for spreading a bedding material in a ditch to provide a bedding layer for laying a pipe thereon, the apparatus having an intake opening for receiving the bedding material, a pair of opposing sidewalls, a forward longitudinal end, an aft longitudinal end, a forward skid plate providing a foreword bottom, a discharge opening formed by lower aft portions of the pair of opposing sidewalls for passing the bedding material therethrough to provide the bedding layer, and a tow means for moving the apparatus longitudinally along the ditch, the improvement comprising:

the lower aft portions of the pair of sidewalls providing two opposing blades which vertically extend for directing the bedding material through the discharge opening to provide a bedding layer within a central portion of the ditch, and which are separated by a lateral distance across the apparatus for determining a horizontal width of the bedding layer;

an upper back-skid plate horizontally extending between the two lower aft portions of the pair of sidewalls for directing the bedding material through the discharge opening to provide the bedding layer, and the upper back-skid plate disposed at a first vertical distance from the bottom of the apparatus for determining a first vertical thickness for the bedding layer; and a lower back-skid plate adapted to be selectively secured beneath the upper back-skid plate to horizontally extend for directing the bedding material through the discharge opening, rather then the upper back-skid plate, and disposing at a second vertical distance from the bottom of the apparatus for determining a second vertical thickness for the compliant bedding layer which is smaller than the first vertical thickness attained using the upper back-skid plate to direct the bedding material to discharge from the apparatus.

2. The improvement of claim 1, further comprising:

a screen for securing across the intake opening for receiving bedding material into the hopper and for preventing from entering the hopper particles mixed with the bedding material which are larger than a predetermined size.

3. The improvement of claim 2, further comprising:

a spoil chute for receiving the particles which are larger than the predetermined size from the screen and providing a pathway for the particles to pass through to discharge on the forward end of the apparatus, the spoil chute formed by upper forward portions of the pair of sidewalls and a spoil chute plate.

4. The improvement of claim 1, further comprising:

two stabilizer arms which laterally extend from opposite lateral sides of the pair of sidewalls for preventing the apparatus from laterally tilting within the ditch.

5. The improvement of claim 1, further comprising:

a plurality of bolts for removably securing the lower back-skid plate beneath the upper back-skid plate at the second vertical distance.

6. The improvement of claim 1, wherein the tow means comprises:

a tow fixture which includes a first and second tow plates, the first tow plate having a first hole therethrough and being secured to an uppermost forward portion of a first one of the pair of sidewalls, and the second tow plate having a second hole therethrough and being secured to an opposing uppermost forward portion of a second one of the pair of sidewalls to dispose the first and second tow plates in an oppositely facing arrangement, with first and second holes oppositely disposed on the forward longitudinal end of the apparatus; and a tow member extending between the first and second tow plates.

7. The improvement of claim 1, wherein the tow means comprises:

a tow fixture which includes a first and second tow plates having a first and second holes therethrough and being secured to an uppermost forward portion of a first one of the pair of sidewalls; and a tow cable passing through the first and second holes to extend between the first and second tow plates.

8. The improvement of claim 1, wherein the upper and lower back-skid plates extend rearward from the aft portions of the pair of opposing sidewalls.

9. In an apparatus for spreading a bedding material in a ditch to provide a bedding layer for laying a pipe thereon, the apparatus having an intake opening for receiving the bedding material, a pair of opposing sidewalls, a forward longitudinal end, an aft longitudinal end, a forward skid plate providing a foreword bottom, a discharge opening formed by lower aft portions of the pair of opposing sidewalls for passing the bedding material therethrough to provide the bedding layer, and a tow means for moving the apparatus longitudinally along the ditch, the improvement comprising:

a screen adapted to be secured across the intake opening for receiving bedding material into the hopper and for preventing from entering the hopper particles mixed with the bedding material which are larger than a predetermined size; and a spoil chute located forward of the screen for receiving the particles which are larger than the predetermined size from the screen and providing a pathway for the particles to pass through to discharge on the forward end of the apparatus, the spoil chute formed by upper forward portions of the pair of sidewalls and a spoil chute plate.

10. The improvement of claim 9, further comprising:

the lower aft portions of the pair of sidewalls providing two opposing blades which vertically extend for directing the bedding material through the discharge opening to provide a bedding layer within a central portion of the ditch, and which are separated by a lateral distance across the apparatus for determining a horizontal width of the bedding layer.

11. The improvement of claim 9, further comprising:

an upper back-skid plate horizontally extending between the two lower aft portions of the pair of sidewalls for directing the bedding material through the discharge opening to provide the bedding layer, and the upper back-skid plate disposed at a first vertical distance from the bottom of the apparatus for determining a first vertical thickness for the bedding layer.

12. The improvement of claim 9, further comprising:

an upper back-skid plate horizontally extending between the two lower aft portions of the pair of sidewalls for directing the bedding material through the discharge opening to provide the bedding layer, and the upper back-skid plate disposed at a first vertical distance from the bottom of the apparatus for determining a first vertical thickness for the bedding layer; and a lower back-skid plate for selectively securing beneath the upper back-skid plate to horizontally extend for directing the bedding material through the discharge opening, rather then the upper back-skid plate, and disposing at a second vertical distance from the bottom of the apparatus for determining a second vertical thickness for the compliant bedding layer which is smaller than the first vertical thickness attained using the upper back-skid plate to direct the bedding material to discharge from the apparatus; and a plurality of bolts for removably securing the lower back-skid plate beneath the upper back-skid plate at the second vertical distance.

13. The improvement of claim 9, further comprising:

an upper back-skid plate extending horizontally and rearward from the two lower aft portions of the pair of opposing sidewalls for directing the bedding material through the discharge opening to provide the bedding layer, and the upper back-skid plate disposed at a first vertical distance from the bottom of the apparatus for determining a first vertical thickness for the bedding layer;

a lower back-skid plate for selectively securing beneath the upper back-skid plate to extend horizontally and rearward from the two lower aft portions of the pair of opposing sidewalls for directing the bedding material through the discharge opening, rather then the upper back-skid plate, and disposing at a second vertical distance from the bottom of the apparatus for determining a second vertical thickness for the compliant bedding layer which is smaller than the first vertical thickness attained using the upper back-skid plate to direct the bedding material to discharge from the apparatus; and a plurality of bolts for removably securing the lower back-skid plate beneath the upper back-skid plate at the second vertical distance.

14. The improvement of claim 9, further comprising:

two stabilizer arms which laterally extend from opposite lateral sides of the pair of sidewalls for providing a means for visual depth control.

15. An apparatus for spreading sand in a ditch to provide a compliant bedding layer for laying a pipe thereon, the apparatus for spreading sand comprising:

a hopper having an opening which extends at an angle to a horizontal plane and which provides an intake for receiving the sand, sidewalls which extend at an angle about the opening for funnelling the sand into the opening, a pair of opposing sidewalls for directing the sand downward within the apparatus;

a container having an upper opening for receiving the sand from the hopper, two sidewall plates defining opposite lateral sides of the container, a forward end plate providing a forward longitudinal end of the container, upper and lower aft end plates providing an aft longitudinal end of the container, a spoil chute plate which defines a forward top portion of the container, a discharge opening formed by the lower aft end plate and lower aft portions of the two sidewall plates for passing sand therethrough, and a forward skid plate providing a foreword bottom for the container and which terminates in a rearward end to provides a hole in the bottom of the container which extends into the discharge opening;

a removable screen for removably securing across the opening in the hopper for receiving sand into the hopper and for preventing from entering the hopper particles, mixed with the sand, which are larger than a predetermined size;

spoil chute for receiving the particles which are larger than the predetermined size from the removable screen and providing a pathway for the particles to pass. through to discharge on the forward end of the apparatus, the spoil chute formed part by upper forward portions of the two sidewall plates and the spoil chute plate;

a tow means for moving the apparatus within the ditch;

the lower aft portions of the two sidewall plates providing two opposing blades which vertically extend for directing the sand to discharge from the container to provide a compliant bedding layer within a central portion of the ditch, and which are separated by a lateral distance across the container for determining a horizontal width of the compliant bedding layer; and an upper back-skid plate horizontally extending between and rearward from the two lower aft portions of the sidewall plates for directing the sand through the discharge opening in the container to provide the compliant bedding layer, and the upper back-skid plate disposed at a vertical distance from the bottom of the container for determining a vertical thickness for the compliant bedding layer.

16. The apparatus of claim 15, further comprising a lower back-skid plate selectively secured beneath the upper back skid plate and horizontally extending rearward of the lower aft portions of the two sidewall plates to direct the sand through the discharge opening, rather than the upper back-skid plate, the lower back-skid plate disposed at a second vertical distance from the bottom of the apparatus for determining a second vertical thickness for the compliant bedding layer which is smaller than the vertical thickness attained using the upper back-skid plate to direct the bedding material to discharge from the container; and securing means for removably securing the lower back-skid plate beneath the upper back-skid plate at the second vertical distance.

17. The apparatus of claim 16, further comprising:

two stabilizer arms which laterally extend from opposite lateral sides of the apparatus for preventing the apparatus from laterally tilting within the ditch, wherein the two stabilizer arms are formed from rectangular tubing and extend from upper aft portions of the two sidewall plates.

18. The apparatus of claim 16, further comprising:

a tow fixture which includes a first and second tow plates, the first tow plate having a first hole therethrough and being secured to an uppermost forward portion of a first one of the two sidewall plates, and the second tow plate having a second hole therethrough and being secured to an opposing uppermost forward portion of a second one of the two sidewall plates to dispose the first and second tow plates in an oppositely facing arrangement, with first and second holes oppositely disposed upwardly of the forward longitudinal end of the container; and a tow cable passing through the first and second holes to extend between the first and second tow plates and above the spoil chute.

19. A method for spreading a bedding material in a ditch to provide a bedding layer for laying a pipe thereon, the method comprising:

providing a bedding material spreader having an intake opening for receiving the bedding material and a discharge opening defined by two vertical members for passing the bedding material rearward of the bedding material spreader;

mounting an upper horizontal plate at a first distance from a lower portion of the bedding material spreader and extending rearward from the vertical members;

pulling the bedding material spreader longitudinally within the ditch to a position adjacent to a portion of the ditch where the bedding material is to be spread;

loading the bedding material through the intake opening and filling the bedding material spreader with the bedding material to a height which is above the discharge opening;

pulling the bedding material spreader longitudinally within the ditch, across the portion of the ditch where the bedding material is to be spread, and causing the bedding material to flow through the discharge opening;

directing the bedding material which is flowing through the discharge opening between the two vertical members to determine a horizontal width for the bedding layer and directing the bedding material which is flowing through the discharge opening below the upper horizontal plate to determine a first vertical thickness for the bedding layer placed within the ditch;

then, if a lesser fill depth is desired, mounting a lower horizontal plate beneath the upper horizontal plate at a second distance from the lower portion of the bedding material spreader to extend rearward from the vertical members for directing the bedding material which is flowing through the discharge opening between the two vertical members to determine a second vertical thickness for the bedding layer placed within the ditch, rather than having the upper horizontal plate determine that the bedding layer have the first vertical thickness.

20. The method of claim 19, wherein the step of loading the bedding material through the intake opening comprises the steps of:

passing the bedding material through a screen to remove particles from the bedding material which are larger than a predetermined size; and directing the particles which are larger than the predetermined size forward of the bedding material spreader to prevent the particles from being placed in the bedding layer placed aft of the bedding material spreader.

* * * * *